United States Patent [19]

Laporte et al.

[11] 4,014,310

[45] Mar. 29, 1977

[54] TRANSPORTABLE TARGET THROWING APPARATUS

[76] Inventors: Jean-Michel Laporte; Jean-Claude Laporte, both of Pont de la Brague, 06603 Antibes, France

[22] Filed: Mar. 27, 1975

[21] Appl. No.: 562,649

[30] Foreign Application Priority Data

Mar. 29, 1974 France ..... 74.11238

[52] U.S. Cl. ..... 124/6; 280/38; 280/64; 124/80; 33/333

[51] Int. Cl.[2] ..... F41B 3/04

[58] Field of Search ..... 124/6, 11, 1, 30 R, 124/43, 49, 50, 81, 82, 80, 7, 8, 9; 33/333; 280/38, 43.14, 43.24, 47.1, 47.12, 64; 273/26 D; 272/83 R

[56] References Cited

UNITED STATES PATENTS

| | | | |
|---|---|---|---|
| 2,391,636 | 12/1945 | McArthur | 124/6 X |
| 2,405,634 | 8/1946 | Batterman | 33/333 |
| 2,806,710 | 9/1957 | Mascaro | 280/43.24 X |
| 2,812,189 | 11/1957 | Geldhof | 280/43.14 |
| 3,277,879 | 4/1964 | Sayette | 273/26 D |
| 3,373,993 | 3/1968 | Oja et al. | 280/43.14 |
| 3,610,223 | 10/1971 | Green | 124/50 X |
| 3,876,198 | 4/1975 | Seligman | 272/83 R X |
| R28,096 | 8/1974 | Earle et al. | 273/26 D |

*Primary Examiner*—Richard C. Pinkham
*Assistant Examiner*—William R. Browne

[57] ABSTRACT

Apparatus for the throwing of clay pigeon type targets, including a throwing arm and an automatic target loading device therefor, is mounted on a trailer chassis so as to be transportable. The transportable target throwing apparatus also includes mechanisms for immobilizing and leveling the chassis on which the loading device and throwing arm are mounted and a shield which protects the loading device and throwing arm from errant shots when in use. The shield, or protective cover, is partially removable from the trailer to permit unobstructed operation of the apparatus.

14 Claims, 4 Drawing Figures

TRANSPORTABLE TARGET THROWING APPARATUS

BACKGROUND OF THE INVENTION:

1. Field of the Invention

The present invention relates to target shooting and particularly to the "throwing" of frangible "clay pigeon" targets. More specifically, this invention is directed to a portable device for the automatic throwing of frangible plate-like targets. Accordingly, the general objects of the present invention are to provide novel and improved methods and apparatus of such character.

2. Description of the Prior Art

Target shooting is an olympic games event of long standing and a sport which is constantly increasing in popularity among the general public. Apparatus for throwing the clay pigeon targets employed in skeet, also known as trap, shooting may be generally classified as either manually operated or automatic. The shooting installations or ranges which employ devices for the automatic loading and throwing of targets typically utilize electrically controlled apparatus which are more or less permanently mounted in a protective shelter comprised of masonry. Such "permanent" or stationary installations are, of course, expensive and require the travel of the shooters to the range.

Previous portable target throwing devices are typically manually operated and are characterized by one or more inherent operational deficiencies. Among these deficiencies are a lack of throwing range, excessive loading time, inherent and variable time delay between the throwing command and release of the target and often a target flight path which fails to follow the desired trajectory.

SUMMARY OF THE INVENTION

The present invention overcomes the above briefly discussed and other deficiencies and disadvantages of the prior art by providing a novel and improved automatic target throwing device which is characterized by portability while having all of the advantages of prior stationary installations. In accordance with the present invention an automatic target throwing mechanism is mounted on a trailer chassis so as to be capable of being towed behind a motor vehicle. The target throwing apparatus includes a throwing arm, means for automatically loading targets from a magazine onto the throwing arm and a device for generating the requisite energy for the functioning of the throwing arm. The invention additionally includes means for keeping the chassis, and thus the throwing apparatus, immobile during operation and a shield for protecting the throwing apparatus from errant shots. Thus, employing the present invention, it is possible to have a precisely operating and automatic target throwing apparatus available at any convenient place.

In accordance with a preferred embodiment of the invention, the trailer chassis is supported, during transportation, on two coaxial wheels. Each of these wheels is mounted on a rocker arm which is resiliently biased into the ground engaging position; the biasing means absorbing shocks during the transporting of the target throwing apparatus from one location to another. The rocker arms for the wheels are designed and mounted such that the wheels may selectively occupy the ground engaging or rolling position and a retracted position wherein the wheels are swung upwardly away from the ground during the operation of the target throwing apparatus. The invention, in a preferred embodiment, also includes a plurality of leveling jacks which, with the wheels swung to the retracted position, support the chassis on the ground.

Also in accordance with a preferred embodiment the portable target throwing apparatus of the present invention is provided with a level which facilitates adjustment of the jacks so that the apparatus may be easily leveled regardless of the terrain where use is desired.

In one embodiment of the invention the protective shield consists of a two part hood which covers the target throwing apparatus on the chassis during transport. A first part of this hood, typically the forwardly disposed part, is capable of removal at the shooting range; the remaining portion of the hood functioning as a shield. Preferably, the remaining or "fixed" part of the hood contains movable flaps which facilitate adjustment and/or loading of the target throwing mechanism. Also, the lateral sides of the hood may be arranged so as to pivot outwardly past the sides of the chassis so that the wheels and tires may also be protected by the hood when in the retracted position assumed during the shooting.

The throwing mechanism of the portable target throwing apparatus of the present invention may also be rotatable with respect to a vertical axis through a plane defined by the trailer chassis whereby the trajectory of the targets to be thrown may be angularly selected in a horizontal plane.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENT

Figure 1:
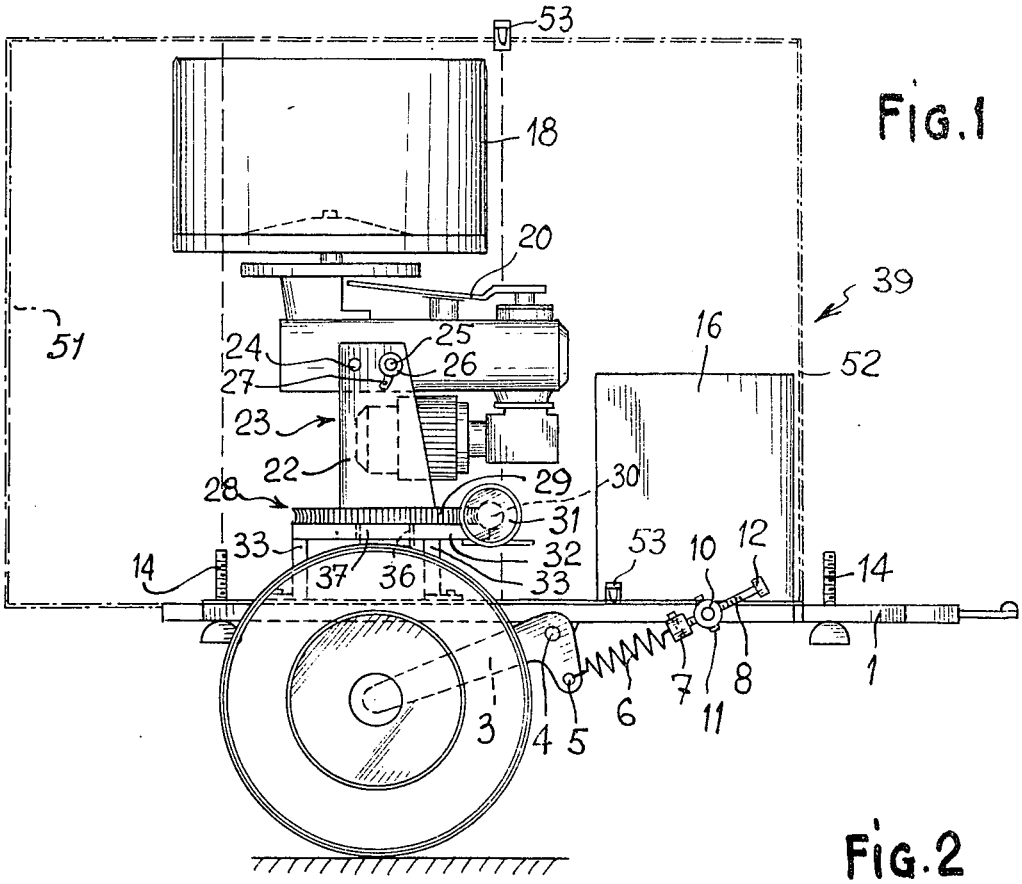
FIG. 1 is a side elevation view of a preferred embodiment of a transportable target throwing apparatus in accordance with the present invention.

With reference now to the drawing, the portable target throwing apparatus of the present invention comprises a frame or chassis 1. As depicted in FIG. 1, the chassis 1 is supported, during transporting of the target throwing apparatus from location to location, on a pair of oppositely disposed coaxial wheels 2. Each of wheels 2 is mounted at the end of an arm 3 of a crank mechanism. The crank mechanisms are, in turn, articulated on a common axle 4 which intercepts the crank mechanism at an elbow portion. The crank mechanisms also have second arms 5. The second arm 5 of each crank mechanism is engaged, at its free end, by a traction spring 6. The opposite ends of the springs 6 are fastened, by means of a nut 7 or other suitable mechanism, to the end of a rod 8. For the purposes to be described below, the rod 8 passes through a connector 10 which is affixed to the chassis 1.

The forward end of chassis 1; i.e., the end to the right in the FIGURES, will be provided with a hitch mechanism of a conventional type whereby the apparatus may be towed behind a motor vehicle.

Figure 3:
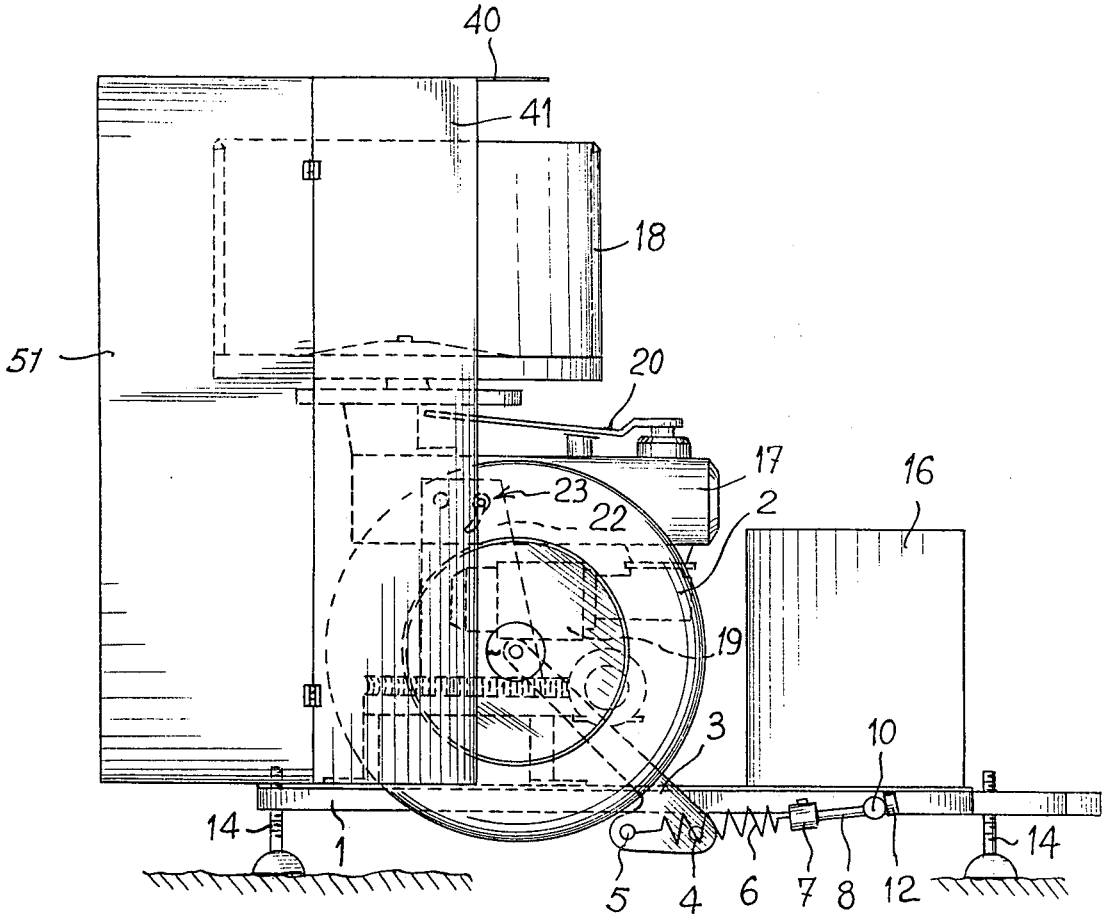
FIG. 3 is a side elevation view of the apparatus of FIG. 1 shown in the use position.

Considering further the mounting and adjustment means for the wheels 2, the aforementioned rod 8 and the connector 10 are provided with holes which, when aligned, may be engaged by a lock pin 11. The free end of rod 8 is also provided with a stop block or head 12. The means for mounting the wheels 2, and particularly the position of axle 4, is selected such that the wheels will be held in the position of FIG. 1 during transportation with the springs 6 absorbing shocks which would otherwise be transmitted to the target throwing apparatus. In the "on road" position of FIG. 1 the pin 11 engages the aligned holes in rod 8 and coupling 10. At the range, when the load is taken off wheels 2 in the manner to be described below, the pins 11 will be removed and the crank mechanisms pivoted about axle 4 to raise the wheels 2 to the retracted position of FIG. 3. In this position the head or stop block 12 of rod 8 is in contact with the coupling 10 and the springs 6 assist in holding the wheels in the retracted position.

Figure 2:
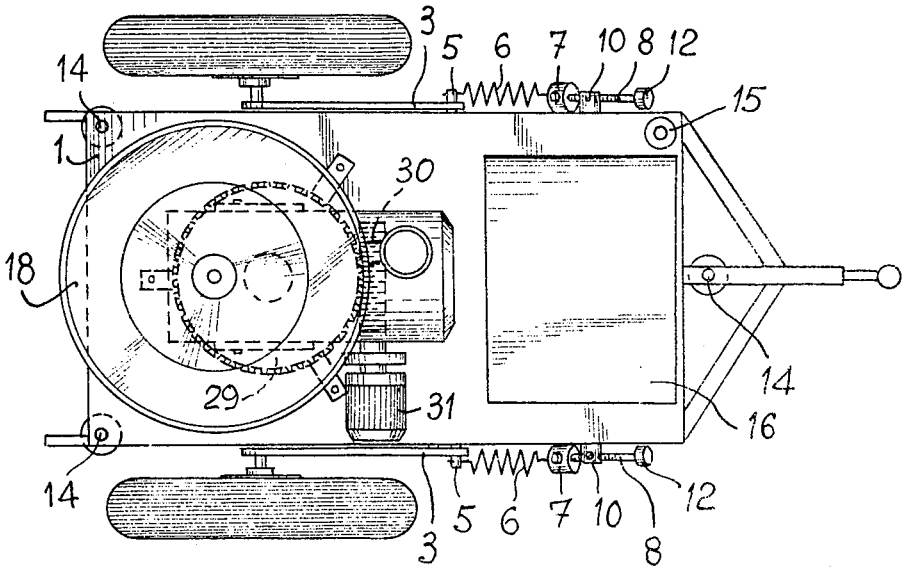
FIG. 2 is a top plan view of the apparatus of FIG. 1.

The apparatus of the disclosed embodiment of the invention is provided with three leveling jacks 14. The apparatus is also provided, as may be seen from FIG. 2, with a level 15. While the jacks 14 have been shown as being of the manually operated screw type, it will be understood that any suitable jack, either manually, hydraulically, pneumatically or electrically operated, may be employed. As may best be seen from FIG. 3, when the device has been positioned at the place where the shooting match is to occur, the jacks 14 are extended downwardly to engage the ground and are adjusted such that the chassis 1 will be level. Engagement of the jacks with the ground permits the wheels 2 to be rotated upwardly to the retracted position.

The chassis 1, supports adjacent the front end thereof, an energy producer or power source 16. The source 16 supplies the energy necessary for the functioning of the target throwing apparatus and its associated feed mechanism. Energy source 16 may be a motor and associated compressor for delivering compressed air if the throwing mechanism is pneumatically operated. Alternatively, the power source 16 may comprise a motor-generator unit or a bank of batteries if the target throwing apparatus is electrically operated.

The target throwing mechanism, indicated generally at 17, is of the type which includes a turret 18 containing a magazine for the targets, a throwing arm 20 which is kept supplied by targets transferred from turret 18 and a motor 19 (FIG. 3) which controls the "cocking" of the throwing arm 20. The motor 19 is preferably electric and is connected to a remote control by means of a long flexible cable; the remote control permitting the selection of the distance the target is to be thrown and also controlling the cocking and release of the throwing arm.

The throwing mechanism 17 is mounted between a pair of wing-like members 22, only one of which is shown in FIG. 1, which define the arms of a fork; the fork being indicated generally at 23. The throwing mechanism is mounted on an axle 24, which engages fork members 22, for angular adjustment. In order to permit adjustment, the members 22 are provided with arc-shaped slots 27 which receive threaded nipples 25 extending outwardly from throwing mechanism 17. Locking of the throwing mechanism 17 in the desired angular position is achieved by means of nuts 26 which engage nipples 25.

The aforementioned fork 23 is mounted on a circular bed plate 28. The plate 28 is provided, about its periphery, with gear teeth which are engaged by a worm gear 30 keyed to the end of the drive shaft of an electric motor 31. Motor 31 is mounted on a stand 32. Stand 32 has legs 33 which are bolted or otherwise secured to chassis 1. The stand 32 supports a vertical central bearing 36 which receives an axle 37 which extends from plate 28. The power for operating motor 31 may be furnished in any convenient manner, typically via a converter, such that the direction of rotation of the throwing mechanism 17 may be selected and controlled. A change in the angular position of the throwing mechanism can be accomplished at the portable target throwing apparatus or, if desired, from a remote location.

In accordance with a preferred embodiment of the invention the portable target throwing apparatus is provided with a hood or cover, indicated generally at 39, which protects the target throwing mechanism 17 and power supply 16 during transportation. The hood 39 is typically in two parts. The first of these parts 51 will remain on the chassis at all times but may be adjusted in the manner to be described below. A second part 52 of the hood 39 is removable. The hood 39 has been shown in phantom in FIG. 1, removed in its entirety in FIG. 2, and with the front or removable portion 52 only removed in FIG. 3. The removable portion 52 of hood 39 is fastened to the portion 51 of the hood which remains on the chassis by means of bolts or other suitable fasteners 53.

The "stationary" part 51 of the hood 39 is provided with an upper articulated screen 40 and a pair of lateral screens or sidewall portions 41. The construction of part 51 of cover 39 may best be seen from FIG. 3. The upper screen 40 may be folded back to facilitate the loading of targets into the turret 18. The lateral side screens 41 are, during shooting, swung slightly outwardly so to form, with the rear surface of the cover, an obtuse angle for the protection of the assembly including the wheels 2. The outward movement of the side screens 41 also permits the throwing mechanism to be angularly adjusted to a position in which the clay pigeons are thrown out slantingly in relation to the shooter.

Figure 4:
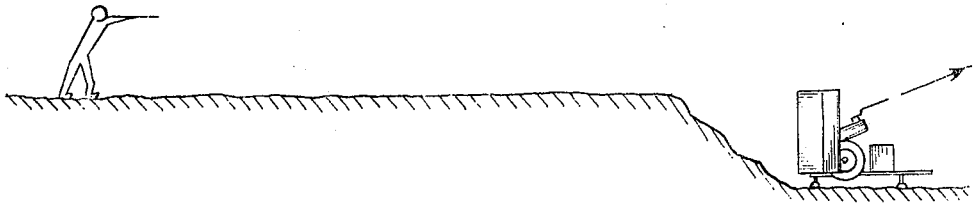
FIG. 4 is a schematic view showing an example of the use of the invention.

As may be seen from FIG. 4, the apparatus of the present invention is preferably situated at a slightly lower elevation than the place where the marksman is standing.

In use the chassis 1 is attached to the back of a motor vehicle when in the condition of FIG. 1; i.e., the cover 39 is installed and the wheels 2 are in the terrain engaging position. When the locale of the shooting is reached, the forward portion 52 of the cover is removed, the side screens 41 extended, the jacks 14 are adjusted so as to level the apparatus; such adjustment being facilitated by the inclusion of the level 15 on the assembly. Finally, the control cables are extended and the target throwing begun. As will be obvious to those skilled in the art, the apparatus of the present invention is very practical and can be placed in operation in a very short time.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. Target throwing apparatus comprising:
a frame;
a pair of wheels;
axle means mounted from said frame for supporting said wheels;
means for mounting each of said wheels on said axle means, said mounting means permitting adjustment of said wheels between two positions, said mounting means each comprising:
a crank, said crank being pivotally mounted on said axle means and having a pair of arms extending outwardly from said pivot connection to said axle means, the free end of a first of said crank arms being connected to a wheel whereby said wheel is rotatably coupled to said crank first arm; and
elastic means for coupling the second arm of said crank to said frame, said elastic coupling means permitting upward retraction of said wheel to a non-ground engaging position;
target throwing means for launching frangible targets into the air, said target throwing means being mounted on said frame, said target throwing means including a throwing arm and means for delivering targets to the throwing arm, said throwing means further including means for controlling the operation of said throwing arm to cause targets to be released for flight;
means mounted on said frame for immobilizing said frame with respect to the ground; and
protective cover means for said target throwing means, said protective cover means being of rigid construction and supported on said frame, said protective cover means functioning as a complete cover during transportation, and being partly removable from the frame for unobstructed operation of the apparatus.

2. The apparatus of claim 1 wherein said elastic means comprises:
a traction spring, said spring having a first end connected to the second arm of said crank; and
means for varying the extension of said traction spring, said extension varying means coupling the second end of said spring to said frame.

3. The apparatus of claim 1 wherein said immobilizing means comprises:
a plurality of jacks mounted on said frame, said jacks being extendable downwardly to engage the ground.

4. The apparatus of claim 1 wherein said apparatus further comprises:
a level mounted on said frame.

5. The apparatus of claim 1 further comprising:
means for rotating said throwing mechanism about a vertical axis, said rotating means being mounted on said frame.

6. Target throwing apparatus comprising:
chassis means for supporting target throwing means, said chassis means including at least a pair of wheels whereby movement of said chassis means across the ground may be facilitated;
target throwing means for launching frangible targets into the air, said target throwing means being mounted on said chassis means, said target throwing means including a throwing arm and means for delivering targets to the throwing arm, said target throwing means further including means controlling the operation of said throwing arm to cause targets to be released for flight;
means mounted on said chassis means for immobilizing said chassis means with respect to the ground;
protective cover means for covering the apparatus, said cover means including;
first cover means removably positionable on said chassis means to envelope and protect at least a first portion of said target throwing means during movement of said chassis means; and
second cover means permanently attached to said chassis means and shielding at least a second portion of said target throwing means during operation thereof, said first and second cover portions cooperating to define a protective envelope for said target throwing means.

7. The apparatus of claim 6 wherein said second cover portion includes:
a plurality of angularly adjustable screens, said adjustable screens being pivotally connected to said chassis means.

8. The apparatus of claim 7 wherein said angularly adjustable screens include:
a pair of lateral side screens, said lateral side screens being pivotal about a vertical axis outwardly with respect to said chassis means.

9. The apparatus of claim 8 wherein said chassis means wheels are coaxial and wherein said chassis means further comprises:
a frame;
axle means mounted from said frame for supporting said chassis means wheels;
means for mounting each of said wheels on said axle means, said mounting means permitting adjustment of said wheels between two positions, said mounting means each comprising:
a crank, said crank being pivotally mounted on said axle means and having a pair of arms extending outwardly from said pivot connection to said axle means, the free end of a first of said crank arms being connected to a wheel whereby said wheel is rotatably coupled to said crank first arm; and
elastic means for coupling the second arm of said crank to said frame, said elastic coupling means permitting upward retraction of said wheel to a non-ground engaging position.

10. The apparatus of claim 9 wherein said immobilizing means comprises:
a plurality of jacks mounted on said chassis means, said jacks being independently extendable downwardly to engage the ground.

11. The apparatus of claim 10 further comprising:
means for rotating said throwing mechanism about a vertical axis, said rotating means being mounted on said chassis means.

12. The apparatus of claim 8 wherein said immobilizing means comprises:
a plurality of jacks mounted on said chassis means, said jacks being extendable downwardly to engage the ground.

13. The apparatus of claim 12 wherein said jacks are independently adjustable.

14. The apparatus of claim 6 further comprising:
means for rotating said throwing mechanism about a vertical axis, said rotating means being mounted on said chassis means.

* * * * *